US005577903A

United States Patent [19]

Yamamoto

[11] Patent Number: 5,577,903

[45] Date of Patent: Nov. 26, 1996

[54] ROTARY COMPRESSOR

[75] Inventor: Yasushi Yamamoto, Kusatsu, Japan

[73] Assignee: Daikin Industries, Ltd., Osaka, Japan

[21] Appl. No.: 500,847

[22] PCT Filed: Dec. 1, 1994

[86] PCT No.: PCT/JP94/02020

§ 371 Date: Aug. 4, 1995

§ 102(e) Date: Aug. 4, 1995

[87] PCT Pub. No.: WO95/16136

PCT Pub. Date: Jun. 15, 1995

[30] Foreign Application Priority Data

Dec. 8, 1993 [JP] Japan ..... 5-307924
Dec. 28, 1993 [JP] Japan ..... 5-334502

[51] Int. Cl.[6] ..... F01C 1/04

[52] U.S. Cl. ..... 418/66; 418/76; 418/94

[58] Field of Search ..... 418/66, 76, 77, 418/79, 94, 96

[56] References Cited

U.S. PATENT DOCUMENTS

| | | | |
|---|---|---|---|
| 1,876,370 | 9/1932 | Weber | 418/66 |
| 2,165,620 | 7/1939 | Doeg | 418/66 |
| 3,070,078 | 12/1962 | Dillenberg | 418/66 |
| 3,269,646 | 3/1965 | August | 418/66 |

FOREIGN PATENT DOCUMENTS

| | | | |
|---|---|---|---|
| 4216099 | 9/1967 | Japan . | |
| 48113011 | 3/1972 | Japan . | |
| 5202874 | 8/1993 | Japan . | |
| 5248380 | 9/1993 | Japan . | |
| 5240179 | 9/1993 | Japan | 418/92 |
| 5312170 | 11/1993 | Japan . | |
| 5306691 | 11/1993 | Japan . | |

*Primary Examiner*—Charles G. Freay

[57] ABSTRACT

A rotary compressor has a cylinder having a cylinder chamber formed therein, a roller fitted around an eccentric portion of a drive shaft and rotatably installed within the cylinder chamber, a blade integrally provided on the roller so as to protrude therefrom and dividing the cylinder chamber into a compression chamber and a suction chamber, and a support body swingably provided in the cylinder and having a receiving groove for receiving a tip portion of the blade in such a manner that the tip portion can move back and forth. On axial faces of the blade and a blade protrusion base portion of the roller, there are formed oil grooves one end of which is opened to an inner peripheral surface of the roller and the other end of which is opened to the tip portion of the blade. In addition, on the rear side of the blade at the receiving groove of the support body, a high pressure chamber closed to the outside of the cylinder is formed. With this configuration, the upper and lower end faces of the roller and blade, and sliding contact portions of the blade and the support body supporting the blade can be securely lubricated. Thus, the reliability is improved.

10 Claims, 6 Drawing Sheets

ROTARY COMPRESSOR

This application commences the National stage under 35 USC §371 of Internal Application No. PCT/JP94/02020, filed Dec. 1, 1994.

TECHNICAL FIELD

The present invention relates to a rotary compressor primarily employed for a refrigeration apparatus.

BACKGROUND ART

Conventionally, there is known a rotary compressor wherein, as described in Japanese Patent Laid-Open Publication No. 5-202874,a blade for partitioning a cylinder chamber into a suction chamber and a compression chamber is integrally provided in a protruding manner on a roller fitted on an eccentric portion of a drive shaft and is swingably supported in a receiving groove of a support body rotatably provided in the cylinder, whereby gaseous fluid is compressed through the rotation of the roller. More specifically, in the conventional rotary compressor, as shown in FIG. 1, a roller B provided with an integral blade B1 protruding radially outwardly from the roller is disposed in the cylinder chamber A1 of cylinder A which is fitted with a confronting front and rear heads on axially opposed sides so that upper and lower end faces of the roller B and blade B1 make a sliding contact with respective faces of the front and rear heads, and a circular pillar-shaped support body C making sliding contact with each head is rotatably supported in the cylinder. A tip portion of the blade B1 is supported on a receiving groove C1 formed in the support body C in such a manner that the blade B1 can swing and move back and forth. Thereby, the inner space of the cylinder chamber A1 is divided into the compression chamber X and the suction chamber Y by the roller B and blade B1. And, by fitting the roller B around the eccentric portion of the drive shaft and revolving the roller B within the cylinder chamber A1 by means of the drive shaft, gaseous fluid is sucked into the suction chamber Y and compressed in the compression chamber X.

In the above-described compressor, because the upper and lower end faces of the roller B and blade B1 are in sliding contact with the heads, it is necessary to lubricate the upper and lower end faces of the roller B and blade B1 with oil supplied thereto. For this purpose, conventionally, a high pressure lubrication oil supplied to sliding contact portions between the eccentric portion of the drive shaft and an inner peripheral surface of the roller B has been supplied there by utilizing a pressure difference between the inner peripheral side of the roller B and the suction chamber Y, a pressure difference between the inner peripheral side of the roller B and the compression chamber X, and a pressure difference between the compression chamber X and the suction chamber Y.

Namely, a pressure difference from the inner peripheral side of the roller B takes place in the suction chamber Y and even in the compression chamber X until the gaseous fluid is compressed to a predetermined pressure in the compression chamber X, and there also exists a pressure difference between the suction chamber Y and the compression chamber X. By utilizing these pressure differences, the high pressure lubrication oil having lubricated the interface between the eccentric portion and the roller B is introduced from the inner peripheral side of the roller B into the compression chamber X and the suction chamber Y via the upper and lower end faces of the roller B and from the compression chamber X into the suction chamber Y via the upper and lower end faces of the blade B1, as indicated by solid arrows n in FIG. 1, whereby the upper and lower end faces of the roller B and the blade B1 are lubricated.

In the conventional compressor, however, because the oil supply to the front and rear heads and to the upper and lower faces of the roller B and blade B1 in sliding contact with faces of the heads is made through clearances between these faces by utilizing the pressure differences, as described above, a pressure difference hardly occurs in hatched portions D and E in FIG. 1, namely, in upper and lower end face portions D at a blade protrusion base portion of the roller B from which the blade protrudes and upper and lower end face portions E on the tip side of the blade B1 entering into the receiving groove C1 of the support body C, and no flow of the lubricating oil takes place there. As a result, there exists a problem that the sliding contact portions of the end faces of the roller B and blade B1 with the faces of the heads cannot be securely lubricated, resulting in a decrease of reliability.

SUMMARY OF THE INVENTION

The object of the present invention is therefore to provide a rotary compressor which is able to securely lubricate the entire axial end surfaces of the roller and the blade and thus to improve the reliability of the rotary compressor.

In order to achieve the above object, a rotary compressor according to the present invention comprises:

- a cylinder having a cylinder chamber formed therein;
- a roller fitted around an eccentric portion of a drive shaft and rotatably disposed within the cylinder chamber;
- a blade integrally provided on the roller so as to protrude therefrom and dividing the cylinder chamber into a compression chamber and a suction chamber;
- a support body swingably provided in the cylinder and having a receiving groove for receiving a tip portion of the blade in such a manner that the tip portion can move back and forth; and
- an oil groove provided on axial end faces of the blade and of a blade protrusion base portion of the roller from which the blade protrudes, said oil groove having one end opened to an inner peripheral surface of the roller and the other end opened to the tip of the blade.

In the rotary compressor configured as described above, the lubrication oil supplied to the inner peripheral side of the roller is forcibly guided, by the centrifugal force acting on the roller during the revolution of the roller, to the tip portion of the blade through the oil groove. At this time, the lubrication oil flowing in the oil grooves is supplied, through the revolution of the roller, to the axial end faces of the blade protrusion base portion of the roller and the axial end faces of the blade. As a result of the oil flow in the oil groove in association with the oil supply utilizing the pressure differences between the inner peripheral surface of the roller, the compression chamber X, and the suction chamber Y, the entire axial end faces of the roller and the blade can be securely lubricated, and therefore the reliability can be improved.

In one embodiment of the present invention, a high pressure chamber closed to the outside of the cylinder is formed on a rear side of the blade at the receiving groove of the support body. More specifically, on the rear side of the blade is formed a high pressure chamber communicating with the inner peripheral side of the roller via the oil groove.

As a result, at the time of revolution of the roller, the high pressure chamber is filled with the lubrication oil introduced to the high pressure chamber from the oil groove, and the lubrication oil is then fed, by pressure difference, toward the suction chamber Y which is held lower in pressure relative to the high pressure chamber, along a suction-chamber-side outer periphery of the support body supported in the cylinder and a suction-chamber-side wall portion of the blade. On the other hand, on the side of the compression chamber X, until the gaseous fluid compressed therein reaches the pressure equivalent to the internal pressure of the high pressure chamber, the lubrication oil in the high pressure chamber is fed, by this pressure difference, to the compression chamber along a compression-chamber-side outer periphery of the support body and a compression-chamber-side wall portion of the blade. As a result, the outer periphery and both of the opposed end faces of the support body and further, the receiving groove can be effectively lubricated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit an scope of the invention will becomes apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
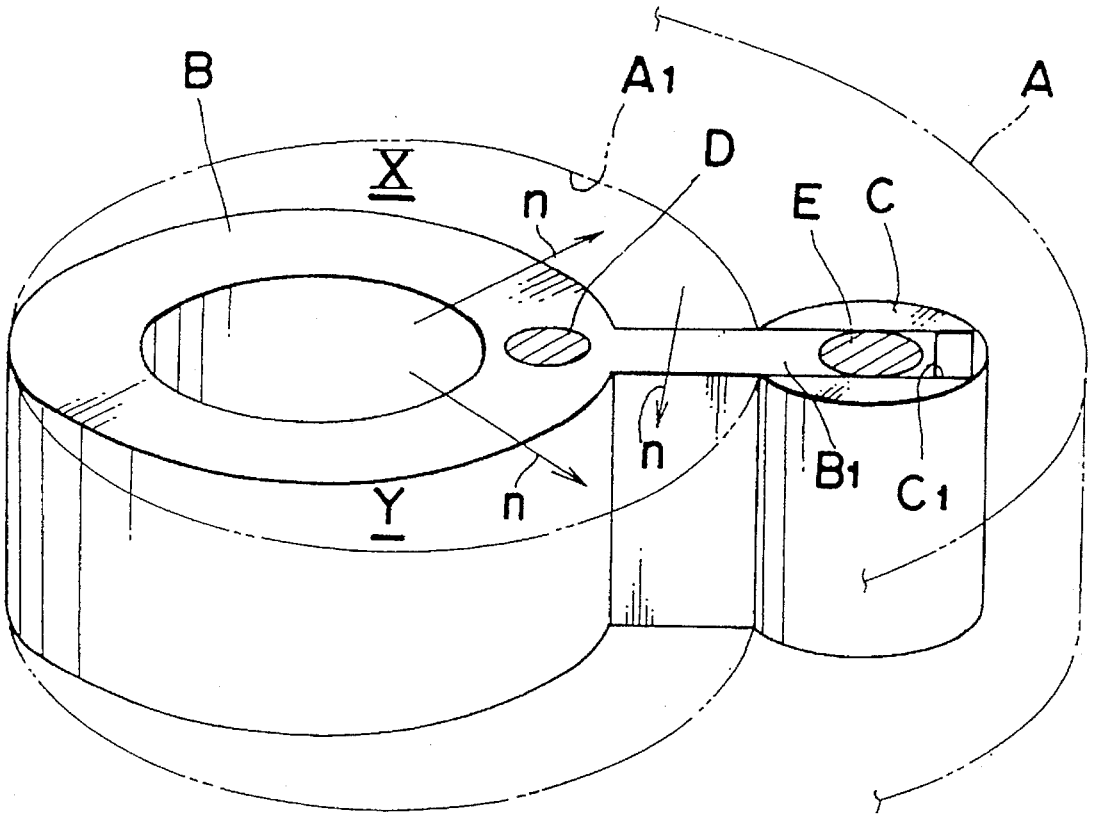
Fig. 1 BACKGROUND ART
FIG. 1 is a perspective view of a conventional roller with a blade formed integrally therewith.
Figure 2:
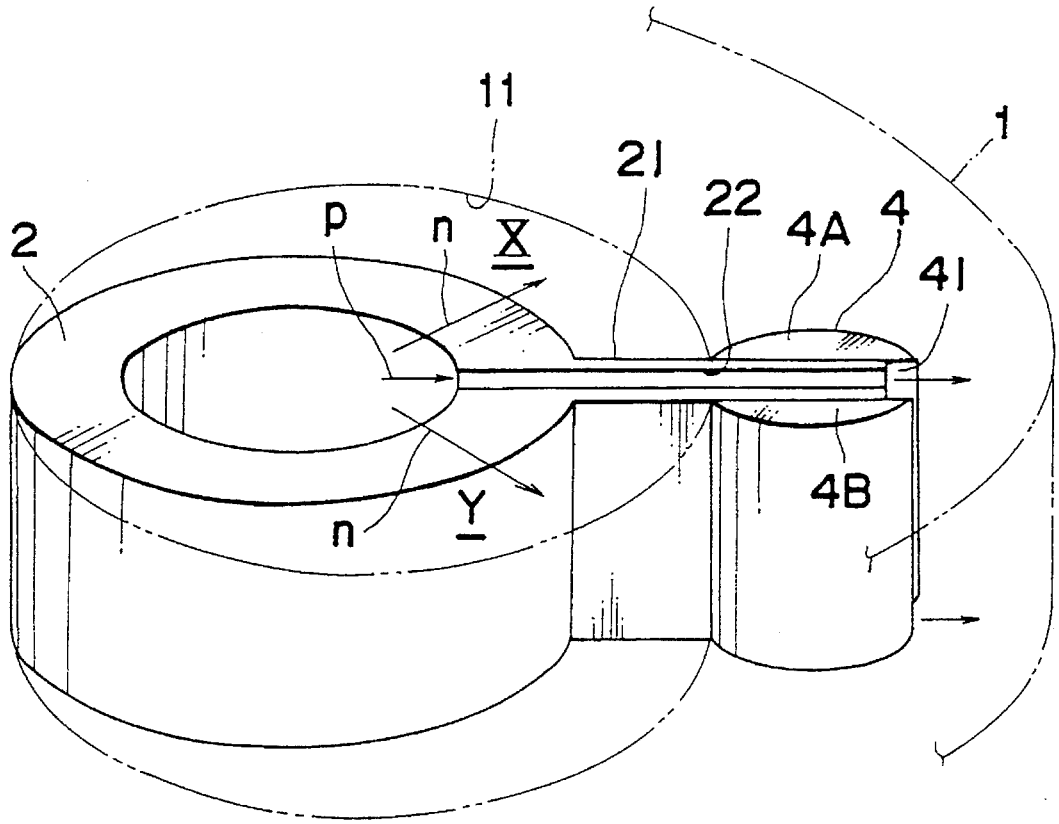
FIG. 2 is a perspective view showing a compression element including a roller in a rotary compressor according to a first embodiment of the present invention.
Figure 3:
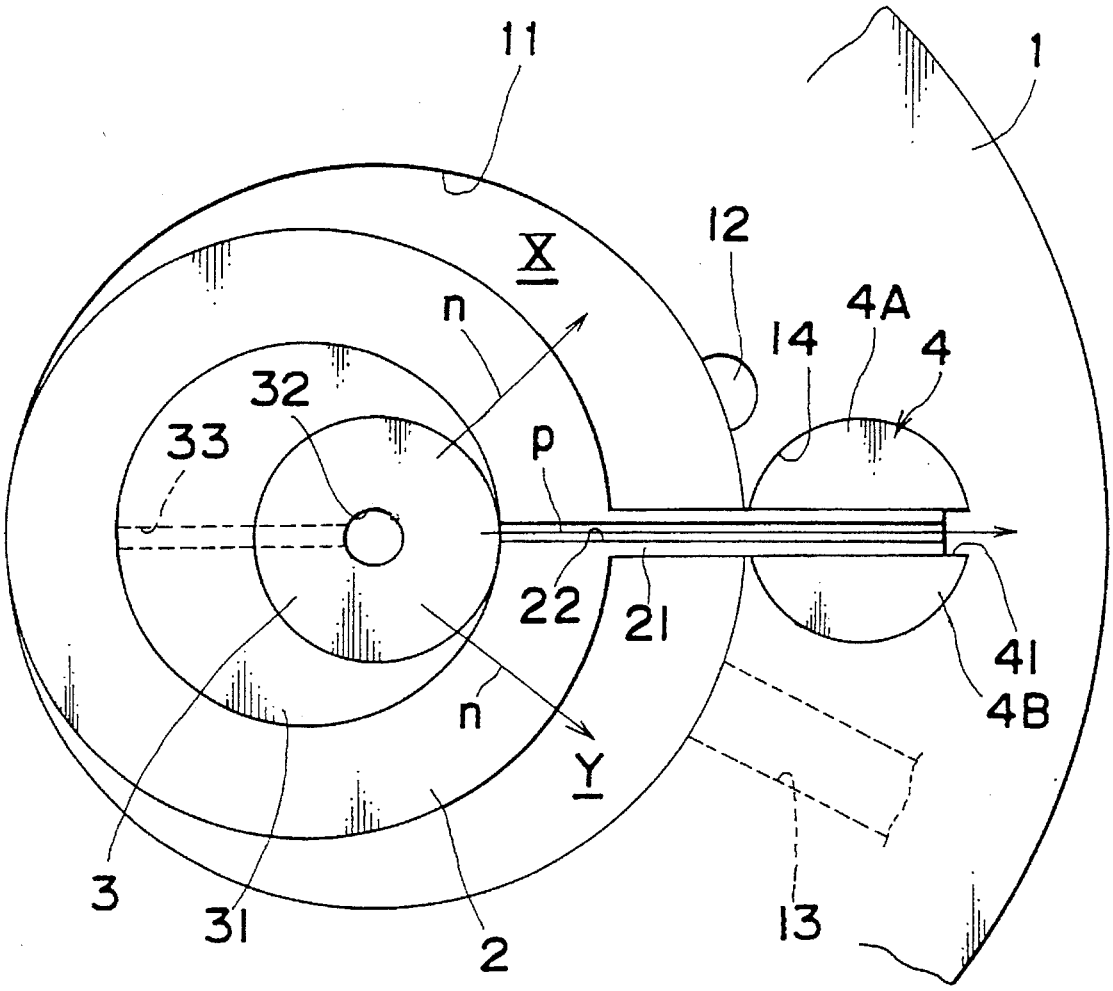
FIG. 3 is a plan view showing essential portions of the first embodiment.

FIGS. 2 and 3 show only the compression element portions of a rotary compressor according to a first embodiment. The compression element is so configured that a roller 2 integrally formed with a blade 21 protruding radially outward from the roller is arranged within a cylinder chamber 11 of a cylinder 1 closed by the faces of front and rear heads (not shown) so that the upper and lower end faces of the roller 2 and blade 21 slidingly contact the faces of the heads. An eccentric portion 31 of a drive shaft 3 is fitted into the roller 2 allowing the roller 2 to revolve through the rotation of the drive shaft 3 while contacting an outer peripheral surface of the roller with an inner wall surface of the cylinder chamber 11. A cylindrical support hole 14 communicating with the inner space of the cylinder chamber 11 is formed in an intermediate position between a discharge port 12 and a suction port 13 provided in the cylinder 1. A support body 14 making sliding contact with the heads is rotatably supported in the support hole 14, and a tip portion of the blade 21 is slidably and back-and-forth movably supported in a receiving groove 41 provided in the support body 4. The support body 4 is formed of two semi-cylindrical, semi-columnar members 4A and 4B, the receiving groove 41 is defined between the two flat confronting faces of the semi-cylindrical members 4A and 4B, and the tip portion of the blade 21 is inserted into the receiving groove 41.

At the time of revolution of the roller 2, an internal space of the cylinder chamber 11 surrounded by a contact line on which the outer peripheral surface of the roller 2 comes into contact with the inner wall surface of the cylinder chamber 11 and a side wall surface of the blade 21 on its front side relative to the revolution direction of the roller 2 is set as the suction chamber Y communicating to the suction port 13. An internal space of the cylinder chamber 11 surrounded by the contact line and a side wall surface of the blade 21 on its rear side relative to the revolution direction is set as the compression chamber X communicating to the discharge port 12. By moving the contact line of the roller 2 on the inner wall surface of the cylinder chamber 11 through the operation of the drive shaft 3, gas is sucked from the suction port 13 into the suction chamber Y, then compressed in the compression chamber X, and then discharged from the discharge port 12. The suction and compression of gas is repeated.

An oil supply passage 32 communicating with an oil supply pump is formed within the central portion of the drive shaft 3. In addition to the oil supply passage 32, a branch passage 33 extending radially outward from the oil supply passage 32 is provided in the eccentric portion 31 of the drive shaft 3 to supply the high pressure oil pumped up to the oil supply passage 32, via the branch passage 33, to sliding contact positions between the inner peripheral surface of the roller 2 and the outer peripheral surface of the eccentric portion 31.

When the roller 2 is actuated to revolve, the inner peripheral side of the roller 2 is brought into a high pressure state by the supply of the pumped-up high pressure oil, and as a result, a predetermined pressure difference takes place at all times between the inner peripheral side of the roller 2 and the suction chamber Y. On the other hand, on the side of the compression chamber X, a pressure difference takes place between the inner peripheral side of the roller 2 and the compression chamber X until gaseous fluid is compressed in the compression chamber X to the same pressure as that of the inner peripheral side of the roller 2. As a result, the high pressure oil supplied to the inner peripheral side of the roller 2 is fed from the inner peripheral portion of the roller to the suction chamber Y and the compression chamber X via upper and lower end faces of the roller 2 as shown by solid arrows n in FIGS. 2 and 3. When the oil is introduced to the suction chamber Y and the compression chamber X, the upper and lower end faces of the roller 2 are supplied with the oil through the revolution of the roller 2.

In the embodiment shown in FIGS. 2 and 3 and constructed as described above, a linear oil groove 22 one end of which is open to the inner peripheral surface of the roller 2 and the other end of which is open to the tip of the blade 21 is formed on the upper and lower end faces of a blade protrusion base portion of the roller 2 from which the blade protrudes and on the upper and lower end faces of the blade 21.

Accordingly, the lubrication oil pumped up to the oil supply passage 32 of the drive shaft 3 and supplied from the branch passage 33 to the sliding contact portions between the roller 2 and the eccentric portion 31 is then forcibly guided to the tip portion of the blade 21, as shown by solid arrows p of FIGS. 2 and 3, along the respective oil grooves 22 by the centrifugal force generated by the revolution of the roller 2. The lubrication oil flowing in these oil grooves 22 is supplied from these oil grooves 22 to the upper and lower end faces of the blade protrusion base portion of the roller 2 and the upper and lower end faces of the blade 21 through the revolution of the roller 2.

As a result, it becomes possible to lubricate securely the entire upper and lower end faces of the roller 2 and blade 21, and to make the rotary compressor excellent in the reliability. It is to be noted that in the embodiment described referring to FIGS. 2 and 3, the tip side of the blade 21 at the receiving groove 41 of the support body 4 is opened, but it may be closed to the outer side of the cylinder 1. In either case, the entire upper and lower end faces of the roller 2 and blade 21 can be securely lubricated.

Figure 4:
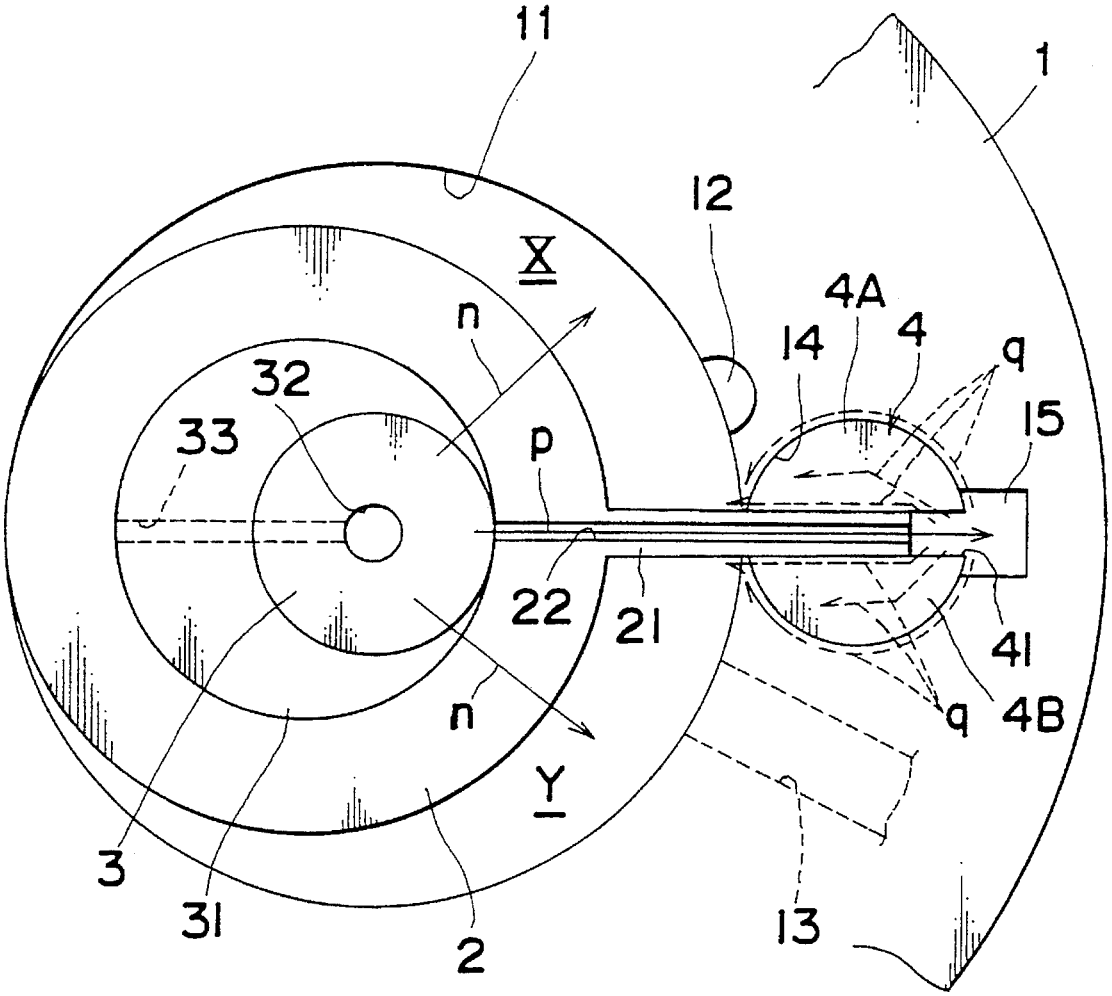
FIG. 4 is a plan view showing essential portions of a second embodiment of the present invention.

In a second embodiment shown in FIG. 4, in a position outside of the support hole 14 in the cylinder 1 on the blade tip side, a high pressure chamber 15 communicating with the receiving groove 41 defined between the two members 4A and 4B of the support body 4 and also communicating with the inner peripheral side of the roller 2 via the oil grooves 22 provided on the blade 21 is formed so as to be closed to the outside of the cylinder 1.

With the above arrangement, when the roller 2 is operated to revolve so as to advance the blade 22 toward the high pressure chamber 15, the high pressure lubrication oil supplied to the inner peripheral portion of the roller 2 is introduced into the high pressure chamber 15 via the oil grooves 22 by the centrifugal force of the roller 2, and fills the high pressure chamber 15. As a result, with the movement of the blade 21, the lubrication oil within the high pressure chamber 15 is fed by a pressure difference to the suction chamber Y along a suction-chamber-side outer peripheral portion of the support body 4 supported in the support hole 14 and a suction-chamber-side wall portion of the blade 21, as indicated by dotted arrows q in FIG. 4. On the other hand, on the side of the compression chamber X, until the gaseous fluid compressed therein rises in pressure up to the pressure equivalent to the internal pressure of the high pressure chamber 15, the lubrication oil in the high pressure chamber 15 is fed by pressure difference to the compression chamber X along a compression-chamber-side outer peripheral portion of the support body 4 and a compression-chamber-side wall portion of the blade 21. By the oil flow from the high pressure chamber 15 to the compression chamber X and suction chamber Y due to pressure differences, the outer peripheral portion, upper and lower end faces and receiving hole 41 of the support body 4 can be supplied with oil. Therefore the outer peripheral portion and upper and lower end faces of the support body 4, and the receiving groove 41 on which the blade 21 slides, can be effectively lubricated.

Figure 5:
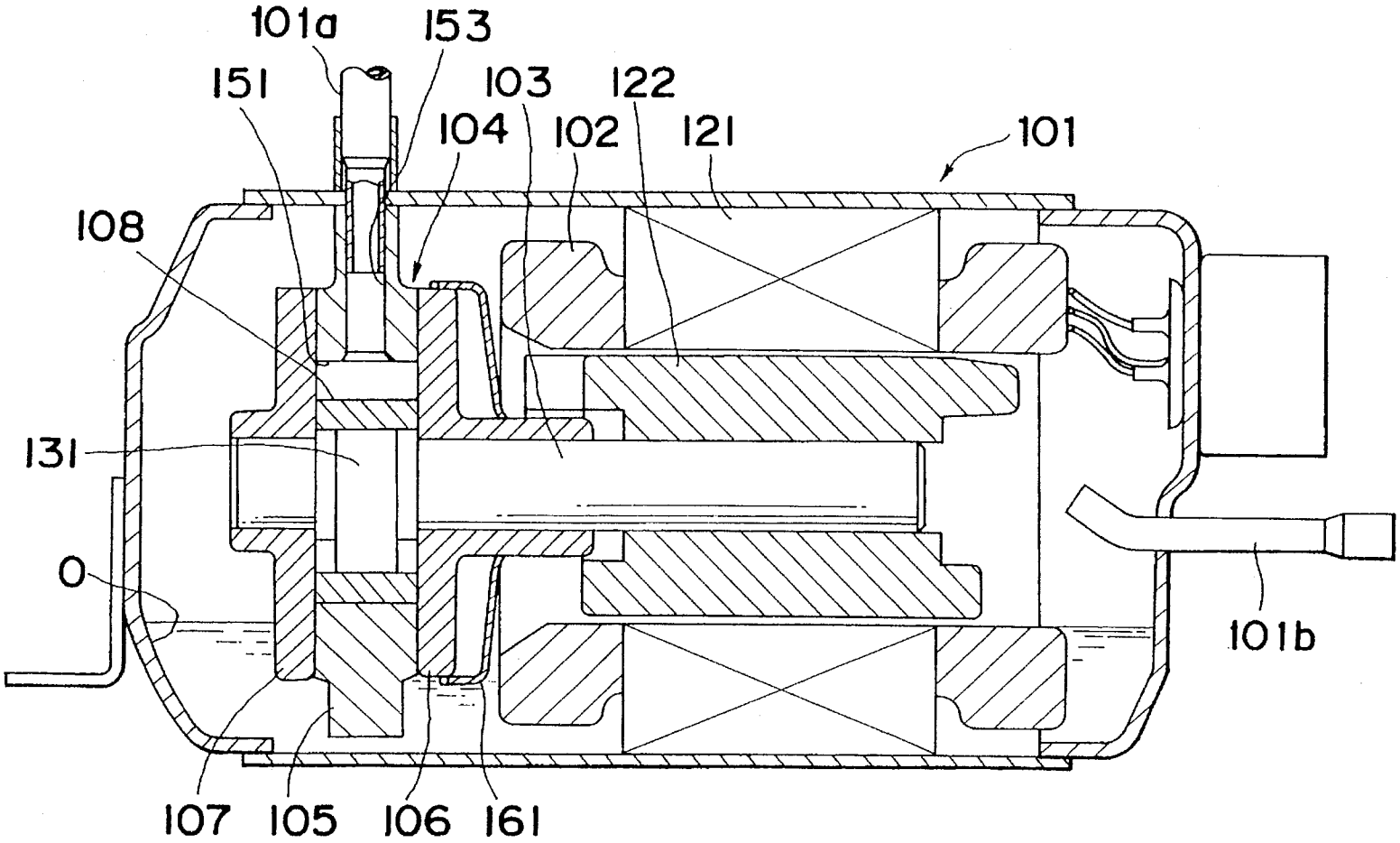
FIG. 5 is a longitudinal sectional view showing the overall configuration of a horizontal rotary compressor according to a third embodiment of the present invention.

FIG. 5 shows the overall configuration of a horizontal rotary compressor having a high pressure dome according to a third embodiment. Within a horizontal casing 101 having an oil sump O at a bottom portion thereof, a motor 102 composed of a stator 121 and a rotor 122 is arranged on one lateral side of the horizontal casing 101. A compression element 104 driven by a drive shaft 103 extends from the rotor 122 and is arranged on the other side within the casing 101. The compression element 104 has a cylinder 105 having a cylinder chamber 151 therein, and a front head 106 and a rear head 107 are arranged on both sides of the cylinder 105 in the axial direction.

Figure 6:
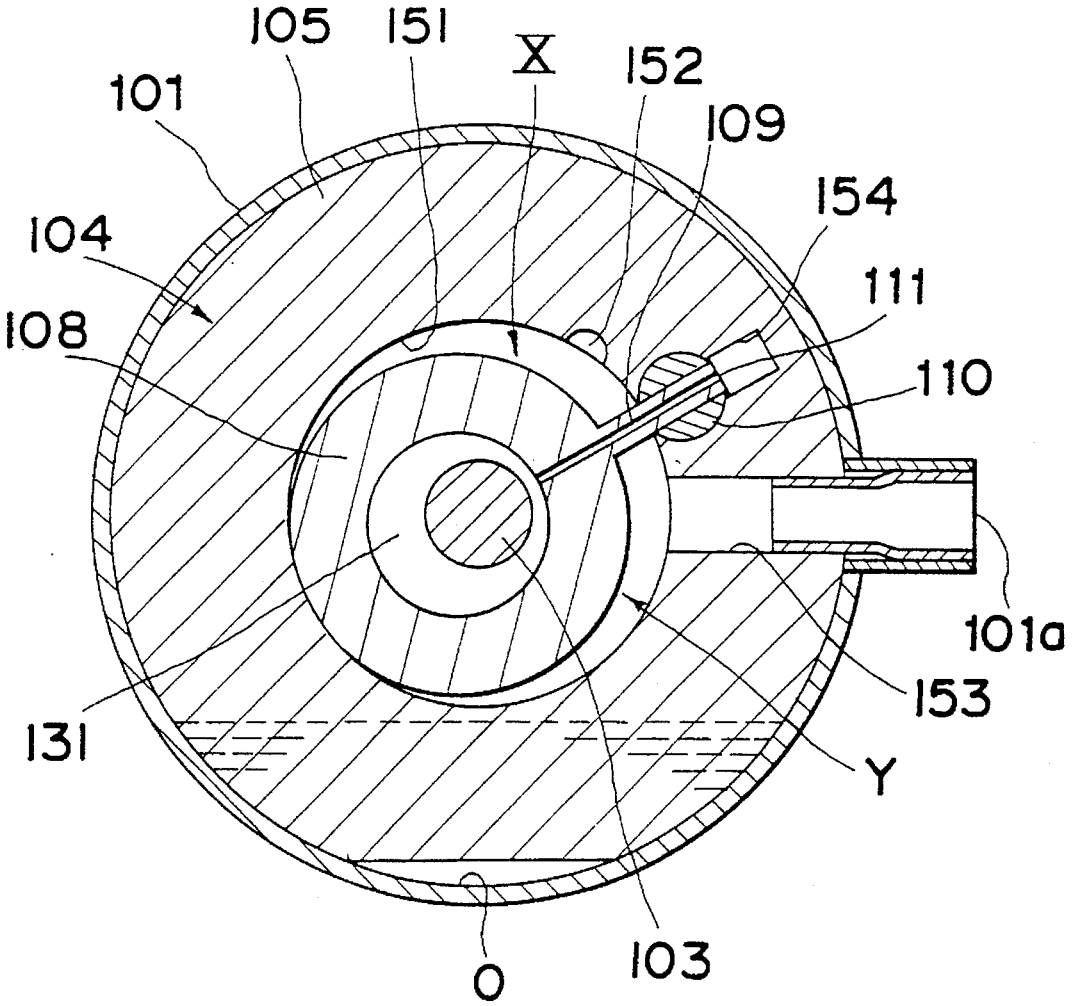
FIG. 6 is a plan view showing essential portions of the third embodiment.

Furthermore, within the cylinder chamber 151 of the cylinder 105, as shown in FIG. 6, a tube-shaped roller 108 fitted on the eccentric portion 131 of the drive shaft 103 is installed. On the roller 108 is integrally formed a blade 109 partitioning the cylinder chamber 151 into a compression chamber X communicating with a discharge port 152 provided on the cylinder 105 and a suction chamber Y communicating with a suction port 153. The blade 109 protrudes from the outer periphery of the roller 108 outward in the radial direction, and the blade 109 is swingably supported by a support body 110 rotatably provided in the cylinder 105.

With the rotation of the drive shaft 103, the roller 108 revolves within the cylinder chamber 151, and gaseous fluid introduced through a suction tube **101*a* connected to the suction port 153 is sucked into the suction chamber Y and then compressed in the compression chamber X. The compressed gas is then discharged from the discharge port 152, via a muffler provided on the outer side of the front head 106, to an internal space of the casing 101 and then to the outside through a discharge tube 101*b* opened to the motor 102 within the casing 101**.

In the horizontal rotary compressor of this embodiment, the blade 109 is disposed slantwise in an upper portion of the cylinder 105 apart from the oil sump O of the casing 101. In addition, an oil chamber 154 being a closed space is formed on a rear side of the blade 109 for supplying oil to the blade 109, and high-pressure oil supplied to the compression chamber X is input, by the pressure difference from a pressure of the compression chamber X, into the oil chamber 154 via a clearance defined between the blade 109 and the support body 110. The oil input into the oil chamber 154 is then output therefrom into the suction chamber Y via a clearance defined between the blade 109 and the support body 110. Contacting portions of the blade 109 are lubricated through the input and output of the oil. Because the blade 109 is supplied with oil from the oil chamber 154 disposed on the rear side of the blade, as described above, it is not necessary to make the blade 109 confront the oil sump O. This makes it possible to set the blade in any desired position in the cylinder 105. Consequently, the blade 109 can be arranged in an upper portion of the cylinder 105 apart from the oil sump O. This makes it possible to provide the discharge port 152 and suction port 153, which must be provided in the vicinity of the blade 109, in positions apart from the oil sump O. Therefore, the suction gas entering from the suction port 153 is prevented from being overheated by the high temperature oil in the oil sump O, whereby the reduction in volume efficiency is suppressed and the power is increased. In addition, because the arrangement of the blade 109 in the upper position in the cylinder 105 allows the suction port 153 to be provided in the cylinder high above the oil sump O, the work for connecting the suction tube **101*a* to the suction port 153 is readily done from one lateral side of the casing 101. Thus, workability can be increased. Furthermore, because there is no necessity to secure a space for the suction tube 101*a* on a lower side of the casing 101, the height of the casing 101** can be reduced when assembled.

Furthermore, on each of the upper and lower end faces of the blade 109 and the blade protrusion base portion of the roller 8 from which the blade 109 protrudes, there is formed an oil groove 111 radially extending therethrough, one longitudinal end of which is open to the inner peripheral surface of the roller 108 and the other end of which is open to the oil chamber 154 provided on the rear side of the blade 109. By provision of the oil grooves 111, the lubrication oil supplied from the oil sump O to the sliding portion of the roller 108 can be positively supplied into the oil chamber 154 via the oil grooves 111 with the aid of the centrifugal force resulting from the revolution of the roller 108 and the oil chamber 154 is always filled with high pressure oil, and therefore, no shortage of oil will take place. Furthermore, this high pressure oil maintains the oil chamber 154 in a high pressure state all the time, the oil in the oil chamber 154 can be fed, by pressure difference, to the suction chamber Y which is held lower in pressure relative to the oil chamber 154, via the clearance between the support body 110 supported within the cylinder 105 and the blade 109. For the compression chamber X, until the gaseous fluid compressed therein reaches the pressure equivalent to that of the oil chamber 154, the lubrication oil in the oil chamber 154 is fed, by pressure difference, to the compression chamber X as well via the clearance between the support body 110 and the blade 109. As a result, the blade 109 can be lubricated more securely and therefore the lubrication performance for the blade 109 is enhanced.

The rotary compressor according to the present invention is primarily employed in refrigeration apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A rotary compressor comprising:

a cylinder having a cylinder chamber formed therein;

a roller rotatably installed within the cylinder chamber, said roller having an inner peripheral surface in sliding contact with an outer peripheral surface of an eccentric portion of a drive shaft;

a blade integrally provided on the roller so as to protrude therefrom and dividing the cylinder chamber into a compression chamber and a suction chamber;

a support body swingably provided in the cylinder and having a receiving groove for receiving a tip portion of the blade in such a manner that the tip portion can move back and forth within the receiving groove; and an oil groove provided on axial end faces of the blade and of a blade protrusion base portion of the roller from which the blade protrudes, said oil groove having a first end opened to the inner peripheral surface of the roller and a second end opened to the tip portion of the blade, said first end of said oil groove contacting said outer peripheral surface of said eccentric portion.

2. The rotary compressor according to claim 1, wherein a high pressure chamber closed to outside of the cylinder is formed on a rear side of the blade at the receiving groove of the support body.

3. The rotary compressor according to claim 1, further including an axial oil passage extending through said drive shaft.

4. The rotary compressor according to claim 3, further including a radial oil passage extending outwardly from said axial oil passage to said outer peripheral surface of said eccentric portion.

5. The rotary compressor according to claim 1, wherein axial end faces of said roller in areas displaced from said blade protrusion base portion are essentially planar and continuous from said inner peripheral surface of said roller to an outer peripheral surface of said roller.

6. The rotary compressor according to claim 1, wherein oil traveling in said oil groove predominantly travels in a direction from said first end to said second end.

7. The rotary compressor according to claim 1, further including an axial oil passage extending through said drive shaft, and a radial oil passage extending outwardly from said axial oil passage to said outer peripheral surface of said eccentric portion, wherein axial end faces of said roller in areas displaced from said blade protrusion base portion are essentially planar and continuous from said inner peripheral surface of said roller to an outer peripheral surface of said roller.

8. The rotary compressor according to claim 7, wherein oil traveling in said oil groove predominantly travels in a direction from said first end to said second end.

9. The rotary compressor according to claim 2, further including an axial oil passage extending through said drive shaft, and a radial oil passage extending outwardly from said axial oil passage to said outer peripheral surface of said eccentric portion, wherein axial end faces of said roller in areas displaced from said blade protrusion base portion are essentially planar and continuous from said inner peripheral surface of said roller to an outer peripheral surface of said roller.

10. The rotary compressor according to claim 9, wherein oil traveling in said oil groove predominantly travels in a direction from said first end to said second end.

* * * * *